US009270003B2

(12) United States Patent
O'Neil et al.

(10) Patent No.: US 9,270,003 B2
(45) Date of Patent: Feb. 23, 2016

(54) STRIPLINE ASSEMBLY HAVING FIRST AND SECOND PRE-FIRED CERAMIC SUBSTRATES BONDED TO EACH OTHER THROUGH A CONDUCTIVE BONDING LAYER

(71) Applicant: Anaren, Inc., East Syracuse, NY (US)

(72) Inventors: Benton O'Neil, Syracuse, NY (US); Adam Cook, Hillsboro, NY (US); Benjamin Shawley, Chittenango, NY (US)

(73) Assignee: Anaren, Inc., East Syracuse, NY (US)

( * ) Notice: Subject to any disclaimer, the term of this patent is extended or adjusted under 35 U.S.C. 154(b) by 150 days.

(21) Appl. No.: 13/803,644

(22) Filed: Mar. 14, 2013

(65) Prior Publication Data

US 2014/0159836 A1 Jun. 12, 2014

Related U.S. Application Data

(60) Provisional application No. 61/734,113, filed on Dec. 6, 2012.

(51) Int. Cl.
*H01P 3/08* (2006.01)
*H01P 11/00* (2006.01)

(52) U.S. Cl.
CPC ..... *H01P 3/085* (2013.01); *H01P 3/088* (2013.01); *H01P 11/003* (2013.01); *Y10T 29/49016* (2015.01)

(58) Field of Classification Search
CPC ..... H01P 3/85; H01P 3/087; H01P 3/088; H01P 3/085
USPC ..... 333/238
See application file for complete search history.

(56) References Cited

U.S. PATENT DOCUMENTS

| | | | | |
|---|---|---|---|---|
| 4,159,507 | A * | 6/1979 | Alfaro | 361/762 |
| 5,164,692 | A * | 11/1992 | Gertel et al. | 333/238 |
| 5,276,414 | A * | 1/1994 | Fujimoto et al. | 333/246 |
| 5,285,570 | A | 2/1994 | Fulinara | |
| 6,917,262 | B2 * | 7/2005 | Poire | 333/204 |
| 7,728,694 | B2 | 6/2010 | Jensen | |
| 2006/0288570 | A1 * | 12/2006 | Cannon et al. | 29/830 |
| 2008/0315977 | A1 * | 12/2008 | Green et al. | 333/238 |

FOREIGN PATENT DOCUMENTS

| | | |
|---|---|---|
| EP | 0563873 | 6/1993 |

* cited by examiner

*Primary Examiner* — Benny Lee
(74) *Attorney, Agent, or Firm* — Frederick J. M. Price; George R. McGuire; Bond Schoeneck & King, PLLC

(57) ABSTRACT

The present invention is directed to a stripline assembly that includes a first pre-fired ceramic substrate including a ground plane disposed on a first surface of the first pre-fired ceramic substrate. A second pre-fired ceramic substrate includes a ground plane disposed on a first surface thereof and a circuit disposed on a second surface of the second pre-fired ceramic substrate opposite the first surface. The circuit is disposed between the first pre-fired ceramic substrate and the second pre-fired ceramic substrate. A conductive bonding layer is disposed around the periphery of the circuit and between the first pre-fired ceramic substrate and the second pre-fired ceramic substrate.

17 Claims, 3 Drawing Sheets

STRIPLINE ASSEMBLY HAVING FIRST AND SECOND PRE-FIRED CERAMIC SUBSTRATES BONDED TO EACH OTHER THROUGH A CONDUCTIVE BONDING LAYER

RELATED APPLICATION DATA

The present application claims the benefit of U.S. provisional patent application No. 61/734,113, filed Dec. 6, 2012, and is hereby incorporated by reference in its entirety.

BACKGROUND OF THE INVENTION

1. Field of the Invention

The present invention relates generally to RF circuits, and particularly to RF circuits using ceramic substrates.

2. Technical Background

A stripline circuit is used in RF and microwave circuit applications and is implemented by disposing a transmission line between two ground planes. A dielectric material is disposed between the transmission line conductor and each of the ground planes. Stripline structures are typically employed in the manufacture of directional couplers, baluns, power dividers and other such devices used in RF, microwave and millimeter wave circuits. Currently there are two industry accepted methods for manufacturing stripline transmission lines and RF/Microwave filters. The first method uses commercially available copper clad laminate materials, whereas the second is based on low temperature co-fired ceramic (LTCC) construction.

With respect to the first method, commercially available copper clad laminates are often used for stripline applications. Copper clad laminates are composite materials typically made by mixing some combination of PTFE, glass, and ceramic materials in accordance with the manufacturer's specific proprietary blend. Stated differently, the manufacturer can tailor the mechanical and electrical properties of the laminate material by varying the mixture ingredients and their amounts. Once the laminate sheet has been produced, it is then clad with copper. Most copper clad laminate materials are mechanically flexible such that they can easily survive the relatively extreme temperatures and pressures associated with the production of multi-layer stripline circuits. In addition, copper clad laminate materials allow for the production of highly complex assemblies that have multiple layers. Moreover, these materials may be used to implement circuits that can operate at very high frequencies. However, there are drawbacks associated with using these laminates for RF, microwave or millimeter wave filters and the like.

One drawback relates to the dielectric loss of laminate materials. Compared to an alumina ceramic material (such as, e.g., the Coors Tek ADS996 material), the dielectric loss can be as much as forty times that of an alumina substrate. In addition, the manufacturing tolerances associated with copper clad laminates are also inferior to that of alumina ceramic materials. For example, the dielectric constant variation of a copper clad laminate can be as much as double that of an alumina substrate. Moreover, the metallization etching tolerances associated with laminate materials can be about five times that possible on an alumina substrate such as the ADS996 material. Finally, the laminate materials have a tendency to warp and stretch during the processing and lamination steps because they are mechanically soft. This warping and stretching introduces alignment errors between etched copper circuit features of the filter and the "drilled-hole" circuit features of the stripline filter. These alignment errors can be as much as five times that possibly with ceramics such as ADS996. All of the aforementioned drawbacks add cost by complicating the filter design and reduce the manufacturing yield of the filter, in addition to degrading the filter's performance.

The second industry accepted method for manufacturing stripline transmission lines and RF/Microwave filters employs low temperature co-fired ceramics (LTCC). LTCC is a process in which a cast ceramic, or "green tape", comprised of ceramic powder and binder is used. The green tape is processed prior to being fired and is thus mechanically soft. In order to create a stripline filter, a metal transmission line layer is screen printed onto the green tape. Additional layers of green tape are placed overtop the metal layer and the assembly is co-fired to complete the process.

There are also drawbacks to the second method (LTCC) process. First of all, the co-firing process, in which both the metallic paste and cast ceramic are fired, causes the entire assembly to shrink somewhat. Much work has been done to predict and control this shrinking, but it still introduces alignment errors between internal metallic layers of the filter and the punched hole features of the filter. Likewise, the copper clad laminate materials used in the first process, the green tape is a composite material that contains both ceramic and binders; thus, the dielectric loss parameters can be as large as sixty times that of alumina materials (See, e.g., the Coors Tek ADS996 material).

In yet another approach, a stripline filter structure employing pre-fired ceramic materials in a laminate structure has been considered. In this approach, two pre-fired ceramic substrates are used to fabricate a stripline structure. The metallic transmission line structure is printed on a surface of one of the pre-fired ceramic layers such that it is disposed between the two substrates. During this process, multiple layers of a glass sealant material are deposited between the pre-fired ceramic layers until a desired thickness is obtained. The thickness is a function of the desired operating frequency of the stripline structure. The glass layers are heated to join the two pre-fired ceramic layers together to create the stripline structure. While the use of pre-fired ceramic layers obviates some of the issues described above, there are drawbacks associated with the process and the resultant stripline product. For example, the application of multiple glass layers requires too many processing steps that result in an increase in processing time. Moreover, the addition of the glass layer prohibits the use of conductive via holes between the center conductor of the stripline and outer ground conductors. These via holes are required for the stripline circuit to function properly. In addition, the resulting stripline structure often experiences tolerance issues that cannot be overcome. As a result, many of the devices are ultimately rejected and deemed to be waste. For all of these reasons, the last approach discussed herein is costly and inefficient.

What is needed therefore is a stripline filter structure that substantially addresses the needs described above. There is a need for a stripline structure that efficiently uses pre-fired ceramic materials and exhibits a dielectric loss parameter that is significantly lower than that possible with either copper clad laminates or LTCC. There is also a need for a stripline structure that exhibits improved manufacturing tolerances vis á vis all of the methods described above.

SUMMARY OF THE INVENTION

The present invention addresses the needs described above by providing a stripline structure that is manufactured by the direct lamination of two layers of pre-fired ceramic substrates. The present invention employs a pre-fired ceramic material that is substantially pure such that the dielectric loss parameter is significantly lower than that possible with either copper clad laminates or LTCC substrates. Another byproduct of the purity of the pre-fired ceramic material is that the dielectric constant variation due to manufacturing tolerances is much better than that possible with LTCC, copper clad laminates or the pre-fired ceramic and glass structure described above. Finally, the present invention exhibits significantly less alignment error between etched circuit features and drilled circuit features because the pre-fired substrates are mechanically rigid at the time of lamination. The present invention thus provides for the design of simpler filter topologies with quicker time to market, improved filter performance, and greater manufacturing yield.

One aspect of the present invention is directed to a stripline filter assembly and a method for manufacturing stripline transmission lines and RF/Microwave filters. Pre-fired ceramic substrates are laminated together using a conductive bonding layer. Depending on the desired performance the ceramic may be as-fired, lapped, or polished. The pre-fired ceramic material may be comprised of an alumina material, such as Coors Tek ADS996, and is conductively coated using thick film processing techniques. One half of the lamination has the stripline center conductors etched therein. A very thin, high dk (dielectric constant), dielectric layer can be applied over the stripline center conductors but within the bonding metallization ring. The application of this dielectric layer significantly improves the performance and manufacturing sensitivity of the circuit. The introduction of this dielectric is for the purpose of electrical improvement not mechanical bonding. Both halves are then printed with a bonding metallization ring and allowed to dry. The halves are mated together and heated. During the heating of the bonding metallization paste, the conductive bond is formed.

In another aspect, the present invention is directed to a stripline assembly that includes a first pre-fired ceramic substrate including a ground plane disposed on a first surface of the first pre-fired ceramic substrate. A second pre-fired ceramic substrate includes a ground plane disposed on a first surface thereof and a circuit disposed on a second surface of the second pre-fired ceramic substrate opposite the first surface. The circuit is disposed between the first pre-fired ceramic substrate and the second pre-fired ceramic substrate. A conductive bonding layer is disposed around the periphery of the circuit and between the first pre-fired ceramic substrate and the second pre-fired ceramic substrate.

In a further aspect, the present invention is direct to a method for fabricating a stripline assembly, the method including one or more of the following steps: forming a first pre-fired ceramic substrate by disposing a ground plane on a first surface of the first pre-fired ceramic substrate and disposing a conductive bonding layer around the periphery of a second surface of the first pre-fired ceramic substrate opposite the first surface; forming a second pre-fired ceramic substrate by disposing a ground plane on a first surface of the second pre-fired ceramic substrate, disposing a conductive bonding layer around the periphery of a second surface of the second pre-fired ceramic substrate opposite the first surface, and disposing a circuit on the second surface of the second pre-fired ceramic substrate; aligning the second surface of the first pre-fired ceramic substrate with the second surface of the second pre-fired ceramic substrate, and mating the first pre-fired ceramic substrate with the second pre-fired ceramic substrate.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description are merely exemplary of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention and together with the description serve to explain the principles and operation of the invention.

DETAILED DESCRIPTION OF THE INVENTION

Figure 1:
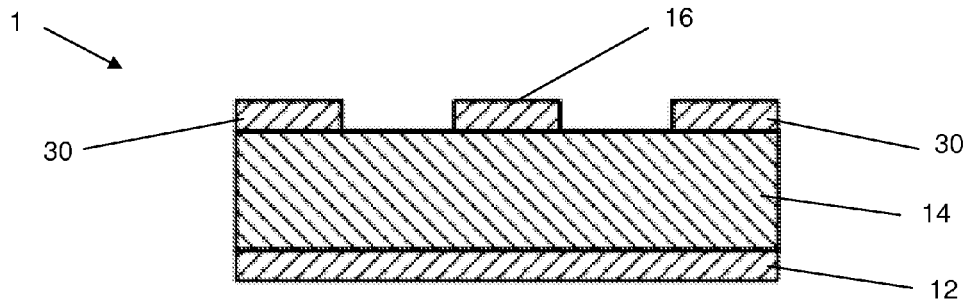
FIG. 1 is a cross-sectional view of a pre-fired substrate having printed artwork and base metallization layer disposed thereon.

Reference will now be made in detail to the present exemplary embodiments of the invention, an example of which is illustrated in the accompanying drawings. Wherever possible, the same reference numbers will be used throughout the drawings to refer to the same or like parts. An exemplary embodiment of the stripline structure of the present invention is shown in FIG. 3, and is designated generally throughout by reference numeral 10.

Referring to FIG. 1, a cross-sectional view of a unit 1 with a pre-fired substrate 14 having printed artwork and a base metallization layer disposed thereon. Specifically, a transmission line structure 16 is disposed on one side of the pre-fired substrate and a ground metallization layer 12 is disposed on the opposite side of the pre-fired ceramic substrate 14 (forming a first unit 1). The bond layer 30 of metallic material is disposed around the periphery of the transmission line structure 16 in a 4-10 μm metal layer using a thick film process. Subsequently, the unit 1 with substrate 14 is fired and etched per the circuit requirements such that the transmission line structure 16 and the bonding metallization layer 30 is disposed on a first surface of substrate 14 thereof, and the ground plane 12 is disposed on the opposite side thereof. A 15-20 μm dielectric layer 17 (FIG. 3) may be deposited atop of the transmission line structure 16 of first unit 1 but within the peripheral bond layer and substrate 14 with dielectric layer 17 is fired again. At the same time, as shown in FIGS. 3-4, a second unit 2 with a substrate 24 (not shown in this view) is also printed, fired and etched in accordance with the design requirements. Stated differently, a ground plane 22 is disposed on one side of the substrate 24 and another 4-10 μm metal bond layer is disposed on the opposite side of substrate 24 using a thick film process. The metal bonding layer is comprised of a gold-tin paste.

Figure 2:
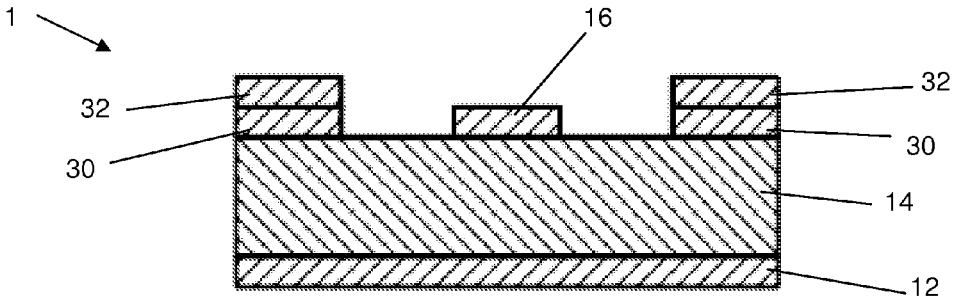
FIG. 2 is a cross-sectional view illustrating the application of an additional layer of metallization material in the bonding areas.

FIG. 2 is a cross-sectional view illustrating the application of an additional layer of metallization material 32 in the bonding areas. After the initial firing and etching of unit 1 with substrate 14, a second 4-10 μm layer 32 of metal bonding paste is deposited onto the bond layer 30, which is on the ceramic layer 14, using the thick film process. Upon application of the second bonding layer 32, it is allowed to dry.

Figure 3:
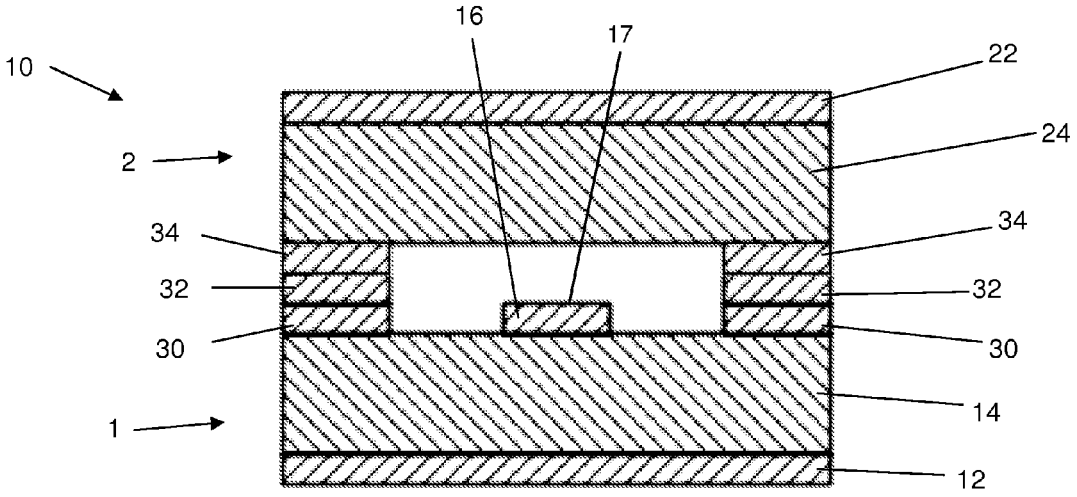
FIG. 3 is a cross-sectional view of the assembled stripline structure unit before a secondary firing is performed.
Figure 4:
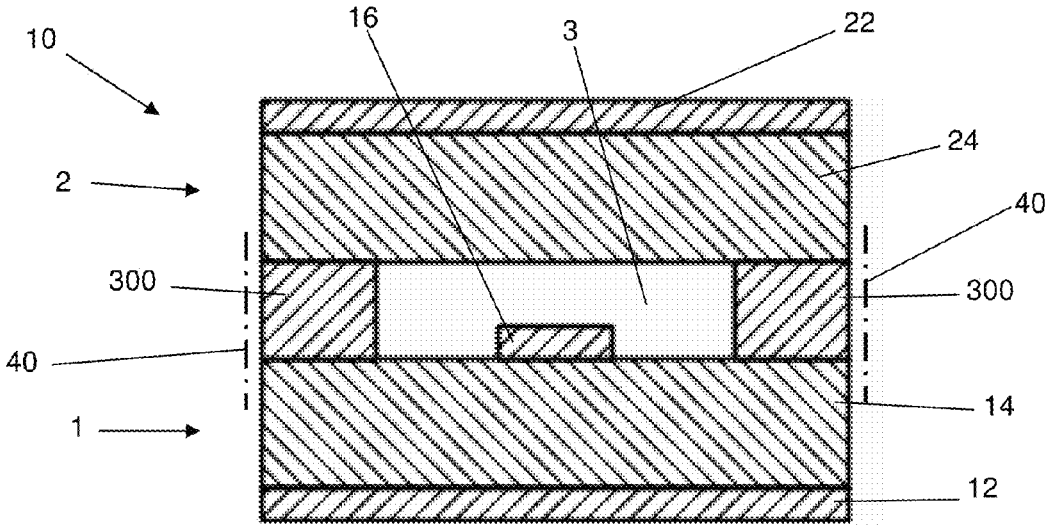
FIG. 4 is a cross-sectional view of the assembled stripline structure unit after the secondary firing is performed.

As embodied herein and depicted in FIG. 3, a cross-sectional view of the stripline assembly 10 (before a secondary firing) is disclosed. Once the second metal bond layer 32 is dry, the two units (1, 2) are aligned and mated to one another. To be clear, at this point in the process, bond layer 30 and bond layer 34 have been applied and melted onto their respective substrates 14, 24. In FIG. 3, therefore, only bond layer 32 is still in paste form. To substantially complete the process, the ceramic assembly 10 is reheated/re-fired such that the 4-10 μm layer of bonding paste 32 melts and bonds with metallization layers (30 and 34) to form a single metallic bonding layer 300 (as shown in FIG. 4).

FIG. 4 is a cross-sectional view of the assembled stripline assembly 10 after the secondary firing is performed. After reheating/re-firing, the laminated ceramic assembly 10 is cooled to room temperature. Due to the absence of any conventional bond layer, an air gap 3 is formed between the two ceramic substrates (14, 24). To prevent contamination of the air gap 3, which may affect the stripline electrical performance, a nonconductive layer 40 is applied to each end of the assembly 10 (i.e., at I/O port openings) to seal the air gap 3 within the structure 10. The non-conductive layer may be formed using any suitable material such as an epoxy or a sealing glass material. The nonconductive layer 40 does not create the primary mechanical bond between the substrates (14, 24) of the stripline structure 10. This is an important point because the bond layer 300 must be formed by the metallization layers (30, 32 and 34) to substantially prevent the tolerance issues described in the background of the invention. The bond layer 300 can be approximately 12-25 μm in thickness after the second firing and the subsequent cooling cycle are completed. Additionally, as mentioned above, the dielectric layer inserted between the bonding rings would accomplish the same effects.

It will be apparent to those of ordinary skill in the pertinent art that modifications and variations can be made to the units 1, 2 and pre-fired ceramic substrates (14, 24) of the present invention depending on the desired electrical properties of the stripline assembly. For example, in one embodiment of the present invention the substrates (14, 24) are pre-fired ceramic substrates, using an alumina material. One example of a suitable alumina material is the Coors Tek ADS996 material. Again, the material selection is based on the desired characteristics of the filter and thick film metallization processes available for a given ceramic material. Those skilled in the art will appreciate that any suitable pre-fired ceramic material may be employed including, but not limited to, aluminum oxide, titanium dioxide ceramics, manganese-titanium ceramics, barium-titanium ceramics, cordierite ceramics, and forsterite ceramics.

The use of the metallization bonding layer in the stripline assembly 10 of the present invention is advantageous for the reasons described herein. The metallization bond 300 is distinctly different from conventional stripline construction methods which typically bond through the use of dielectric bonding plys or dielectric sintering, as in the case of low temperature co-fired ceramics. In similar fashion, the pre-fired ceramic approach described in the background section also employs a dielectric bonding layer (glass). Thus, unlike all of the approaches described in the background section, the present invention uses a conductive bonding layer as compared with a dielectric bonding layer to bond pre-fired ceramic. This technique also has the distinct advantage of forming a highly controllable bond line thickness to within a few microns of height without the need for polishing or lapping. As a result, the present invention provides a method for mass manufacturing high performance stripline filters that have tight tolerances at low cost. This advantage can clearly be seen when comparing the amount of processing steps used in the assembly of the pre-fired ceramic stripline. As detailed herein the present invention utilizes only six main processing steps in the creation of the ceramic stripline, as where other processes have shown to need ten to fifteen processing steps in the creation of the stripline.

Figure 5:
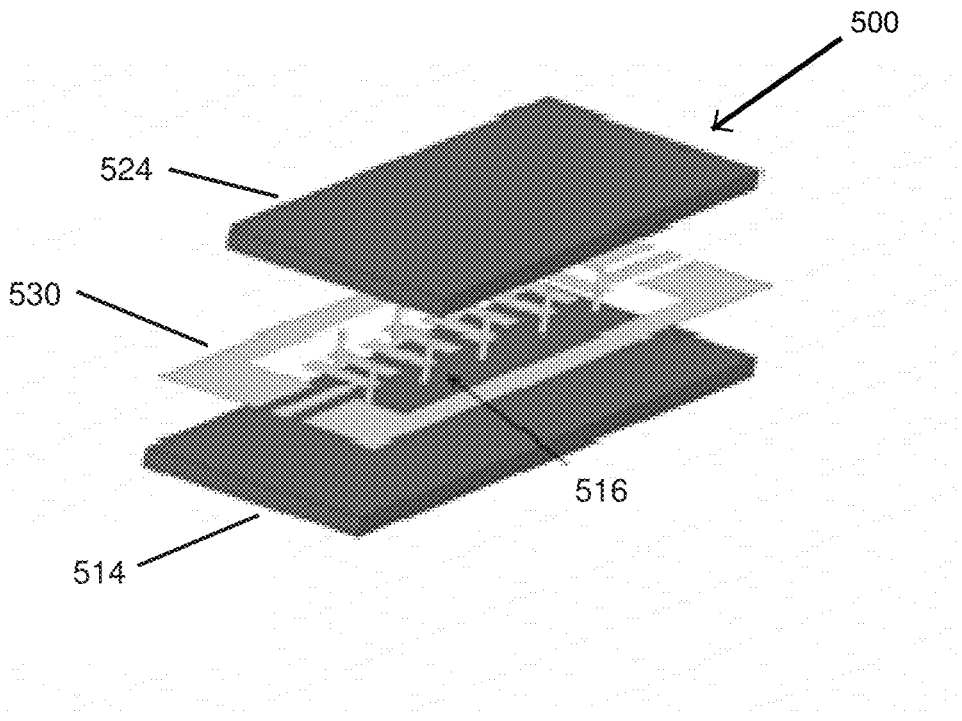
FIG. 5 is an exploded isometric view of the stripline structure unit according to an embodiment of the present invention.

As described above, the bonding layer 300 is formed using a thick film paste metallization process using any suitable gold conductor paste material such as, e.g., Heraeus C5756 paste that has been formulated for use with Al or Au wire bond applications. However, the present invention is not limited to this embodiment. It will be apparent to those of ordinary skill in the pertinent art that modifications and variations can be made to bonding layer 300 of the present invention depending on the performance requirements of the assembly. For example, other metallization compounds including, but not limited to, gold-tin preforms, gold-tin solder, or conductive epoxies may be employed. Each of the alternative bonding materials requires the designer to compensate for the tolerances achievable with each bonding method. The preferred embodiment produces spacing and overall tolerances which far exceeding the tolerances achieved by conventional stripline manufacturing techniques FIG. 5 is an exploded isometric view of the stripline assembly 500 according to an embodiment of the present invention. This embodiment is similar to the embodiments discussed herein and can include a first pre-fired ceramic substrate 514, a second pre-fired ceramic substrate 524, a bonding metallization layer (or ring) 530 and a transmission line structure (or stripline filter) 516.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. The term "connected" is to be construed as partly or wholly contained within, attached to, or joined together, even if there is something intervening.

The recitation of ranges of values herein are merely intended to serve as a shorthand method of referring individually to each separate value falling within the range, unless otherwise indicated herein, and each separate value is incorporated into the specification as if it were individually recited herein.

All methods described herein can be performed in any suitable order unless otherwise indicated herein or otherwise clearly contradicted by context. The use of any and all examples, or exemplary language (e.g., "such as") provided herein, is intended merely to better illuminate embodiments of the invention and does not impose a limitation on the scope of the invention unless otherwise claimed.

No language in the specification should be construed as indicating any non-claimed element as essential to the practice of the invention.

It will be apparent to those skilled in the art that various modifications and variations can be made to the present invention without departing from the spirit and scope of the invention. There is no intention to limit the invention to the specific form or forms disclosed, but on the contrary, the intention is to cover all modifications, alternative constructions, and equivalents falling within the spirit and scope of the invention, as defined in the appended claims. Thus, it is intended that the present invention cover the modifications and variations of this invention provided they come within the scope of the appended claims and their equivalents.

What is claimed is:

1. A stripline assembly comprising:

a first pre-fired ceramic substrate including a ground plane disposed on a first surface of the first pre-fired ceramic substrate;

a second pre-fired ceramic substrate including a ground plane disposed on a first surface thereof and a circuit disposed on a second surface of the second pre-fired ceramic substrate opposite the first surface, the circuit being disposed between the first pre-fired ceramic substrate and the second pre-fired ceramic substrate; and a conductive bonding layer disposed around the periphery of the circuit and between the first pre-fired ceramic substrate and the second pre-fired ceramic substrate, wherein said conductive bonding layer is formed from more than one metallic bonding layer.

2. The assembly of claim 1, further comprising a cavity formed in an interior region of the assembly between the first pre-fired ceramic substrate, the second pre-fired ceramic substrate, and the conductive bonding layer.

3. The assembly of claim 2, further comprising a nonconductive layer on an outside surface of said assembly sufficient to seal said cavity.

4. The assembly of claim 3, wherein said nonconductive layer does not form a primary mechanical bond between said first pre-fired ceramic substrate and said second pre-fired ceramic substrate.

5. The assembly of claim 1, wherein said conductive bonding layer is formed from a gold conductor paste material.

6. The assembly of claim 1, wherein said conductive bonding layer is formed from a metallization compound selected from the group consisting of gold-tin preforms, gold-tin solder, and conductive epoxies.

7. The assembly of claim 1, wherein said circuit further comprises a dielectric layer deposited on the second surface of the second pre-fired ceramic substrate.

8. The assembly of claim 1, wherein at least one of said first and second pre-fired ceramic substrates is formed from a pre-fired ceramic material selected from the group consisting of aluminum oxide, titanium dioxide ceramics, manganese-titanium ceramics, barium-titanium ceramics, cordierite ceramics, and forsterite ceramics.

9. A method for fabricating a stripline assembly, the method comprising:

forming a first pre-fired ceramic substrate by disposing a ground plane on a first surface of the first pre-fired ceramic substrate and disposing a first conductive bonding layer around the periphery of a second surface of the first pre-fired ceramic substrate opposite the first surface, wherein the first conductive bonding layer comprises a second surface opposite a first surface of the first conductive bonding layer facing the periphery of the second surface of the first pre-fired ceramic substrate;

forming a second pre-fired ceramic substrate by disposing a ground plane on a first surface of the second pre-fired ceramic substrate, disposing a second conductive bonding layer around the periphery of a second surface of the second pre-fired ceramic substrate opposite the first surface, wherein the second conductive bonding layer comprises a second surface opposite a first surface of the second conductive bonding layer facing the periphery of the second surface of the second pre-fired ceramic substrate and disposing a circuit on the second surface of the second pre-fired ceramic substrate;

aligning said second surface of said first pre-fired ceramic substrate with said second surface of said second pre-fired ceramic substrate, and mating said first pre-fired ceramic substrate with said second pre-fired ceramic substrate, wherein said mating forms a combined bonding layer comprising said first conductive bonding layer and said second conductive bonding layer.

10. The method of claim 9, wherein the step of forming said first pre-fired ceramic substrate further comprises the step of firing said first pre-fired ceramic substrate sufficient to bind said ground plane on said first surface of said first pre-fired ceramic substrate, and to bind said first conductive bonding layer around the periphery of said second surface of said first pre-fired ceramic substrate.

11. The method of claim 10, wherein the step of forming the second pre-fired ceramic substrate further comprises the step of firing said second pre-fired ceramic substrate sufficient to bind said ground plane on said first surface of the second pre-fired ceramic substrate, and to bind said second conductive bonding layer around the periphery of said second surface of the second pre-fired ceramic substrate.

12. The method of claim 11, further comprising the step of disposing said second conductive bonding layer around the periphery of the second surface of the second pre-fired ceramic substrate.

13. The method of claim 12, wherein the step of disposing said second conductive bonding layer is performed using a thick film process.

14. The method of claim 12, wherein the step of mating further comprises mating the second surface of the first conductive bonding layer with the second surface of the second conductive bonding layer.

15. The method of claim 14, further comprising the step of firing said mated first pre-fired ceramic substrate and said second pre-fired ceramic substrate sufficient to bind said conductive bonding layer surfaces together and to form the combined bonding layer.

16. The method of claim 15, wherein the steps of mating and firing further comprises the step of forming a cavity in an interior region of the stripline assembly between the first pre-fired ceramic substrate, the second pre-fired ceramic substrate, and the combined bonding layer.

17. The method of claim 16, further comprising the step of sealing the cavity by providing a nonconductive layer on an outside surface of said assembly.

* * * * *